US005816787A

United States Patent [19]

Brinkerhoff et al.

[11] Patent Number: 5,816,787

[45] Date of Patent: Oct. 6, 1998

[54] MOTION CONVERSION ROTATOR APPARATUS AND METHOD

[76] Inventors: Robert B. Brinkerhoff, 1170 E. Elgin Ave., Salt Lake City, Utah 84106; Verdon C. Brinkerhoff, deceased, late of St. George, Utah; by Charlene P. Brinkerhoff, executor, 1285 W. 5830 N., St. George, Utah 84770

[21] Appl. No.: 637,296

[22] Filed: Apr. 24, 1996

[51] Int. Cl.[6] ..... F04B 21/04; F04B 49/00

[52] U.S. Cl. ..... 417/521; 417/293; 417/552; 417/555.1

[58] Field of Search ..... 184/11.1, 13.1; 74/55, 569; 417/273, 285, 293, 523, 552, 555.1, 521

[56] References Cited

U.S. PATENT DOCUMENTS

| | | | |
|---|---|---|---|
| 1,370,305 | 3/1921 | Golle | 417/523 |
| 3,716,310 | 2/1973 | Guenther | 417/552 |
| 5,035,221 | 7/1991 | Martin | 417/273 |

FOREIGN PATENT DOCUMENTS

| | | | |
|---|---|---|---|
| 61074 | 6/1943 | Denmark | 417/521 |

*Primary Examiner*—Charles G. Freay
*Attorney, Agent, or Firm*—Marcus G. Theodore

[57] ABSTRACT

A method and apparatus to convert the torque of a drive shaft into reciprocating energy to drive and pull a piston utilizing a nodal rotator attached to the drive shaft, or alternatively to convert reciprocating energy into torque, said rotator having compression and repositioning means associated with cam followers which drive and pull opposed pistons and cylinders in air compressors, internal combustion engines, and other technology.

17 Claims, 7 Drawing Sheets

MOTION CONVERSION ROTATOR APPARATUS AND METHOD

BACKGROUND OF THE INVENTION

1. Field

This invention pertains to methods and devices which convert the torque of a drive shaft into reciprocating energy to drive a piston and vice versa. More particularly, it provides a method and apparatus to attach a nodal rotator to a drive shaft, said rotator having compression and repositioning means associated with cam followers which drive and pull opposed pistons and cylinders in air compressors and other technology.

2. Background of the Invention

Current industrial compressor technology is predominantly of two types, rotary screw and reciprocating. There are several other types such as rotary vane, but they are of limited utility at high pressure. Rotary screw technology consists of two screws that rotate into each other trapping air and forcing it into ever-increasingly smaller chambers. Because of the friction between the two screws as they rotate into each other, compression takes place largely in the presence of lubricant, which evaporates in the heat of the compression chamber contaminating the compressed air. To avoid this problem, special oil-free rotary screw models are available, but suffer from limited size and pressure capability. They also employ closer tolerances which increase the machining costs. These rotary screws also generate a lot of heat, and are difficult to cool with an oil or refrigerant based cooling system. They thus required more maintenance than reciprocating compressors. These rotary screw compressors are therefore large and heavy relative to the amount of air delivered, and are typically more expensive than other types of compressors.

Reciprocating compressors consist of one or more pistons driven by a connecting rod attached to a crankshaft. Air is introduced into the cylinder through the cylinder head on the down-stroke of the piston, being compressed and expelled through the piston head on the up stroke. While rotary screw compressors are not cost effective to manufacture in smaller sizes, reciprocating compressors do not have economic size limitations. One of the disadvantages of a reciprocating compressor is that the gas is heated prior to compression by bringing it in through the top of the cylinder. This greatly reduces efficiency and increases operating temperature. Another disadvantage is the way in which the connecting rod converts the torque from the drive shaft to the reciprocating energy to drive the piston. The connecting rod imparts force at an angle to the piston on both the up-stroke and the down-stroke, placing considerable pressure on the sidewall of the cylinder, which is known as "side-load". This side-load wastes energy and requires reinforced cylinder walls to withstand the temperature and pressure generated. To reduce side-load friction, the movement of the piston requires lubrication. Although the lubrication system employs separate seals to isolate the lubricant from the air being compressed, small amounts of oil are left on the cylinder wall on the down-stroke of the piston. This oil then evaporates and contaminates the air being compressed.

In addition, reciprocating compressors generally required a counterweight to offset the weight of the piston. This increases the weight of the compressor, its size, and the energy required to operate the machine. Further, heavy metal housings and bearings must be employed to withstand the vibration and torque produced by the counterweight, and the heat of compression.

The invention described below minimizes the problems association with rotary screw and reciprocating compressors and provides a smaller, more efficient compressor in 2 to 100 horsepower modules. It can be made of plastic because heat and vibration are isolated. In addition, side-load friction is reduced so thick sided cylinder sidewalls are not needed. Oil lubrication is isolated and prevented from entering the cylinder. This oil-free compressed air or gas is produced without filtration and the associated costs.

The invention also directly converts torque energy to reciprocating energy along anti-frictional rolling surfaces to significantly reduce energy losses. Thus there are no counterweights and crankshafts, so oval wear associated with crankshafts and connecting rods is eliminated. The invention also employs a commonality of parts over a wide range of sizes, and allows several pistons to run out of the same thin housing.

SUMMARY OF THE INVENTION

The invention comprises a method and motion conversion rotator apparatus particularly adapted for use with air compressors, although it can also be adapted for use with other reciprocating piston devices. It comprises adapting a housing with walls defining an inner rotator chamber to align opposing pairs of thin walled cylinders with equally weighted pistons having piston rods with ends entering the rotator chamber. The rotator then pushes and pulls the piston rods to activate the pistons as described below. It can also be adapted to have the rotator pushed by a cam follower to produce torque on the drive shaft.

The housing is constructed of light weight rigid materials, such as plastic, polypropylene, aluminum, etc., which define thin walled even numbered sets of aligned opposing cylinders surrounding an inner rotator chamber. In another variation utilizing an odd number of cylinders, these cylinders are uniformly spaced about the inner rotator chamber to maintain a center of rotation so that the center of gravity of the reciprocating cylinders and pistons never changes during operation. Preferably, this housing can also hold oil in a reservoir in the bottom of the rotator chamber into which the rotator ends dip to continually lubricate the guide rail system.

At least two equal mass, counterbalanced, opposing reciprocating pistons are then mounted within each respective opposed cylinder. In one preferred piston embodiment, the pistons are of two piece construction which avoids the need for split rings, and provides low friction oil-less rings.

A piston rod with first and second ends is attached by the first end to each piston such that the second end of each piston rod extends into the rotator chamber. To prevent the piston rods from vibrating, track guides are attached to the housing and associated with the piston second ends to hold said ends in alignment as they move back and forth.

A rotator with at least two equidistant nodal ends is attached to a drive shaft journal mounted to the housing to rotate within the rotator chamber. The rotator has compression and repositioning means associated with cam followers which drive and pull opposed pistons and cylinders in air compressors and other technology. In the preferred embodiment, the rotator has an elliptical shape with two nodes located 180 degrees apart. However, the rotator can take any number of equiangular shapes, such as a triangular shape with three nodes located 120 degrees apart.

The rotator has a compression and repositioning guide rail system along its perimeter edge. A preferred guide rail system comprises a rail running along the perimeter of the rotator with an outer rail surface which creates a pushing force against the cam follower means associated with the second ends of the piston rods as the rotator turns part way during the compression stroke. It has an inner lip surface which creates a pulling force as the rotator turns to pull the cam follower means associated with the second ends of the piston rods as the rotator completes its turn during the expansion stroke. The interior curve of the inner lip is a function of the shape of the rotator, the size of the cam followers, and the size of the rotator to form an interior curve that allows the rotator to turn without locking. It thus varies with the shape of each rotator to define a loci path of the cam followers. Thus, the cam follower means are bearing mounted to run along the guide rail system and are operably associated with the second ends of the piston rods to alternatively push and pull the pistons in response to the rotation of the rotator.

In one preferred embodiment, the cam follower means comprise a linear shaft attached to each piston rod with a carriage arrangement. This carriage arrangement has a set of pushing and pulling cam followers attached to the linear shaft in a configuration which secures them onto and along the guide rail system. The pushing cam followers travel the outer configuration of the rotator guide rail system to be pushed by the rotator as the rotator turns. The pulling cam followers travel the inner lip configuration of the rotator guide rail system to be pulled as the rotator turns. Also attached to the shaft on both sides of the track guide to prevent rotation of the shaft and reduce side load during rotation of the rotator are track guide cam followers with bearings.

In one preferred embodiment for compressor usage, the housing defines aligned, opposed, thin walled cylinders of hemispherical design similar to those shown in Brinkerhoff, U.S. Pat. No. 4,242,878. Brinkerhoff also employs corresponding thin walled dome shaped hollow pistons to provide for rapid heat transfer, and added structural strength operable in the cylinders to compress a compressible gas. Valve means in the piston admit compressible gas into the cylinder. Conduit means in the housing remove compressed gas from the cylinder. Cooling means for cooling the compressed gas leaving the cylinder are then included to prevent heat build-up.

The valve means associated with the piston are linearly aligned with a cylinder check valve which releases compressed air out of the cylinder. These valve means in their simplest configuration include an inlet valve, and an unloading valve. The inlet valve is located proximate the base of the piston. It leads into an air path behind the hollow of the piston to provide cooling inlet air behind the piston head during the compression stroke of the piston. This one way inlet valve prevents the outflow of trapped air during the intake stroke of the piston. Thus, the stagnation pressure rises due to dynamic pressure increases in the air as the piston accelerates toward the closed inlet valve; thereby providing increased total pressure and a flow path only through the piston head and into the hemispherically shaped cylinder. This increases the air mass intake, which provides a cooler operating gas compressor system.

When the inlet valve closes, it blocks the external noise generated during the intake stroke of the piston so that these air pressure wave noises are stopped at the closed inlet valve, resulting in quieter operations. The inlet valve has a valve seat constructed of a soft, quiet, flexible material, such as fiberglass reinforced gasket material, instead of noisy metal finger valves. This is possible because of the near ambient low temperature conditions at the inlet valve, which again results in quieter operations.

The unloading valve in the head of the piston is in communication with the air path behind the piston into which inlet air is drawn in through the inlet valve. The unloading valve slides through a high temperature linear bearing mounted with the piston head. Inertia forces of the moving valve components are opposite to the piston movements which helps open the valve during the intake stroke, and close the valve during the compression stroke. This unloading valve is normally open at rest. It remains open until the drive motor reaches a pre-determined threshold RPM limit when it is activated via inertia to alternatively open and close to provide cool air flowing through the inlet valve during each intake stroke to cool the reinforced plastic seal material. Alternatively, this unloading valve has a predetermined RPM at which it opens. To further insure that the inlet air remains cool, unloading valve has a piston cap covering the face of the seal to provide a protective thermal barrier during the compression stroke to prevent the inlet air from being heated by the compressed air.

The unloading valve is spring dampened in both directions of motion, to prevent impact damage. Preferably, the linear unloading valve also includes adjustable inertia weights and double springs to provide a means to optimize the spring compression for proper valve closing during start-up.

The thin walled cylinders are surrounded by a cooling chamber which is filled with circulating coolants which remove heat from cylinder locations where compression heat is generated. This continual cooling of the compression cylinders enables the use of soft, high temperature plastic materials, such as fiber reinforced silicone seating material for the check valve.

The invention thus provides a highly efficient motion conversion rotator apparatus and method for reciprocating piston systems. This method adapts a housing with walls surrounding and defining an inner rotator chamber in a manner to align at least two opposed cylinders about the inner rotator chamber. At least two equal mass counterbalanced opposing reciprocating pistons are then mounted within each respective opposed cylinder such that the piston assemblages move uniformly about a center of rotation such that the center of gravity never changes. These pistons have piston rods with second ends extending into the rotator chamber adapted with cam follower means associated with and activated by a nodal rotator with cam follower means attached to a journal mounted drive shaft. To prevent side load wear, track guide means are attached to the housing and associated with the second ends of each piston rod to hold said ends in alignment as they reciprocate back and forth. The method thus provides a device that converts the torque of the drive shaft to reciprocating energy to drive the piston via an efficient rotator associated with a drive shaft.

The method directly converts torque energy to reciprocating energy, and vice versa, along anti-frictional rolling surfaces to significantly reduce energy losses and eliminate the need for counterweights and crankshafts. Consequently, oval, wear associated with crankshafts and connecting rods is eliminated. The invention also employs a commonality of parts over a wide range of sizes. It also allows several pistons to run out of the same thin housing.

When associated with a compressor, the invention provides an efficient compressor in 2 to 100 horsepower modules. It can be made of light weight plastic because heat and vibration are isolated, and heavy sided cylinder sidewalls are not needed. Oil lubrication is isolated and prevented from entering the cylinder to produce oil free compressed gas.

DESCRIPTION OF THE ILLUSTRATED EMBODIMENTS

Figure 1:
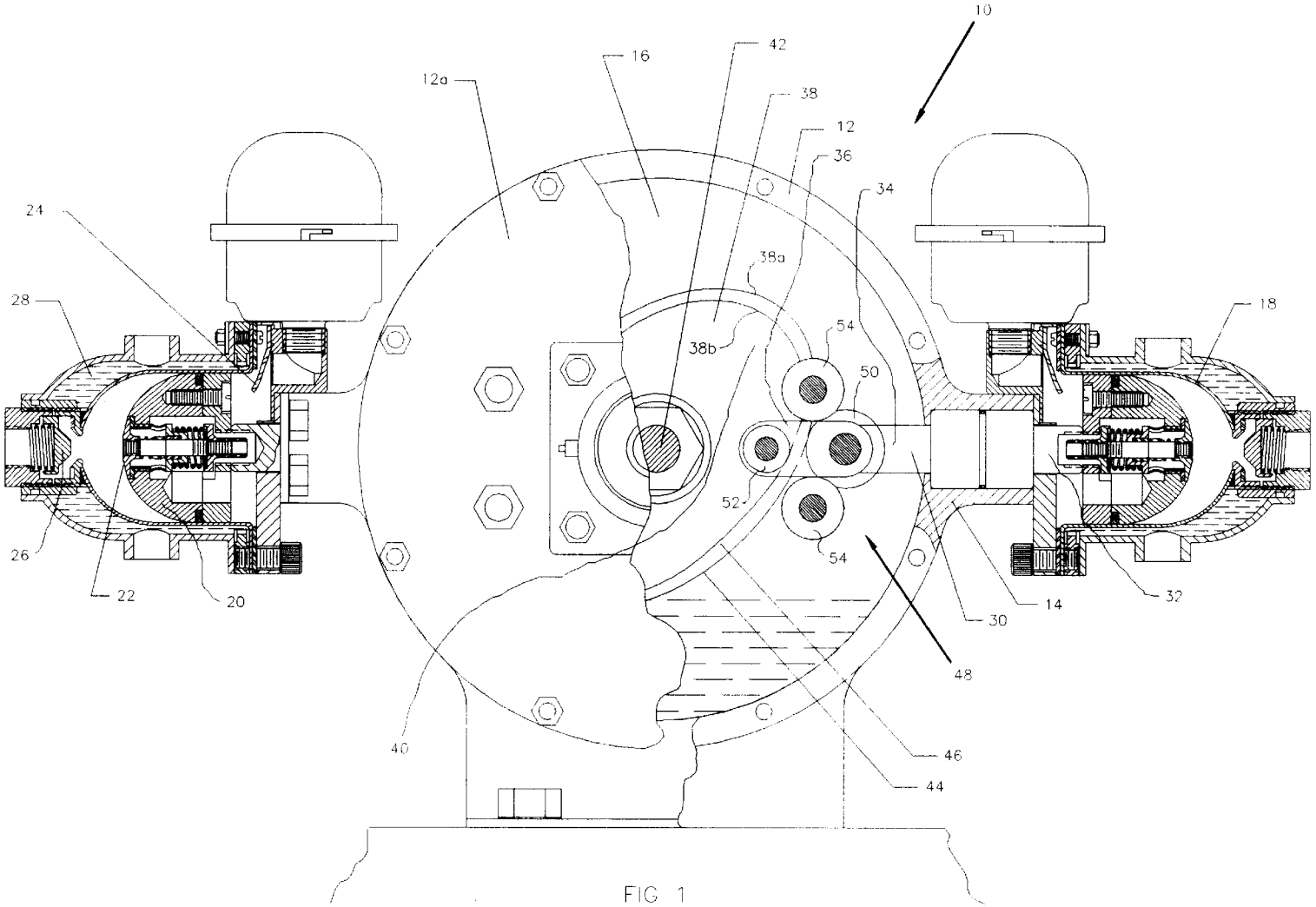
FIG. 1 illustrates a preferred embodiment of the invention associated with a compressor.

FIG. 1 illustrates motion conversion rotator apparatus adapted to drive an air compressor 10. A housing 12 with walls 14 defines an inner rotator chamber 16. A pair of aligned and opposed thin walled hemispherical compression cylinders 18 are mounted within the housing walls 14 and open into the inner rotator chamber 16. A pair of equal mass counterbalanced opposing thin walled reciprocating dome shaped pistons 20 are mounted within each respective opposed cylinder 18. A piston valve 22 in the top of the piston 20 admits compressible gas into the cylinders 18. An inlet valve 24 allows inlet air to enter the hollow behind the pistons 20 to pass through the piston valve 22, when opened. After the piston 20 compresses the gas in the compression stroke, conduit means, i.e. an outlet valve 26 in the top of the dome of the cylinders 18 opens to release compressed gas from the cylinders 18. Cooling means, i.e. a circulating coolant reservoir 28 surrounding the cylinders 18, absorb and carry away heat built up during the gas compression cycle to cool the compressed gas leaving the cylinder and prevent heat buildup.

To power the cylinders 18 and pistons 20, each piston 20 has a piston rod 30 with a first end 32 attached to each piston and a second end 34 extending into the rotator chamber 16. Track guides 36 attached to the shaft of the second end 34 are associated with the piston second ends 34 to hold said ends in alignment as they reciprocate back and forth. A rotator 38 with at least two equidistant nodal ends 40 attached to a drive shaft 42 journal mounted to the housing 16 to rotate within the rotator chamber 16. The rotator 38 has a guide rail system along its perimeter edge which comprises a rail running along the perimeter of the rotator 38 with a first outer rail surface 44 which creates an alternative pushing force against the cam follower system as the rotator 38 turns, and a second inner pulling surface 46 which creates a pulling force as the rotator 38 turns to pull the cam follower means as the rotator completes its turn.

Cam follower means 48 are operably associated with the second ends 36 of the piston rods 34 to run along the guide rail system to alternatively push and pull the opposed pistons 20 along a single plane in response to the rotation of the rotator 38. They comprise set of pushing and pulling cam followers 50, 52, 54 attached to the shaft 34 and mounted onto and along the guide rail system. The pushing cam followers 50 travel the outer configuration of the rotator guide rail system to be pushed by the rotator 38 as the rotator 38 turns. The pulling cam followers 52 travel the inner configuration of the rotator guide rail system to be pulled as the rotator 38 turns. The guide rail cam followers 54 attached to the face plate 12*a* of the housing 12 are located on both sides of the track guides 36 to prevent rotation of the shaft 34 and reduce side load during operation of the rotator.

The rotator 38 has an elliptical shape with two nodes located 180 degrees apart. To provide adequate lubrication, the housing 12 rotator chamber 16 is partially filled with oil at a level such that the rotator ends 40 dip into to continually lubricate the guide rail system.

Figure 2:
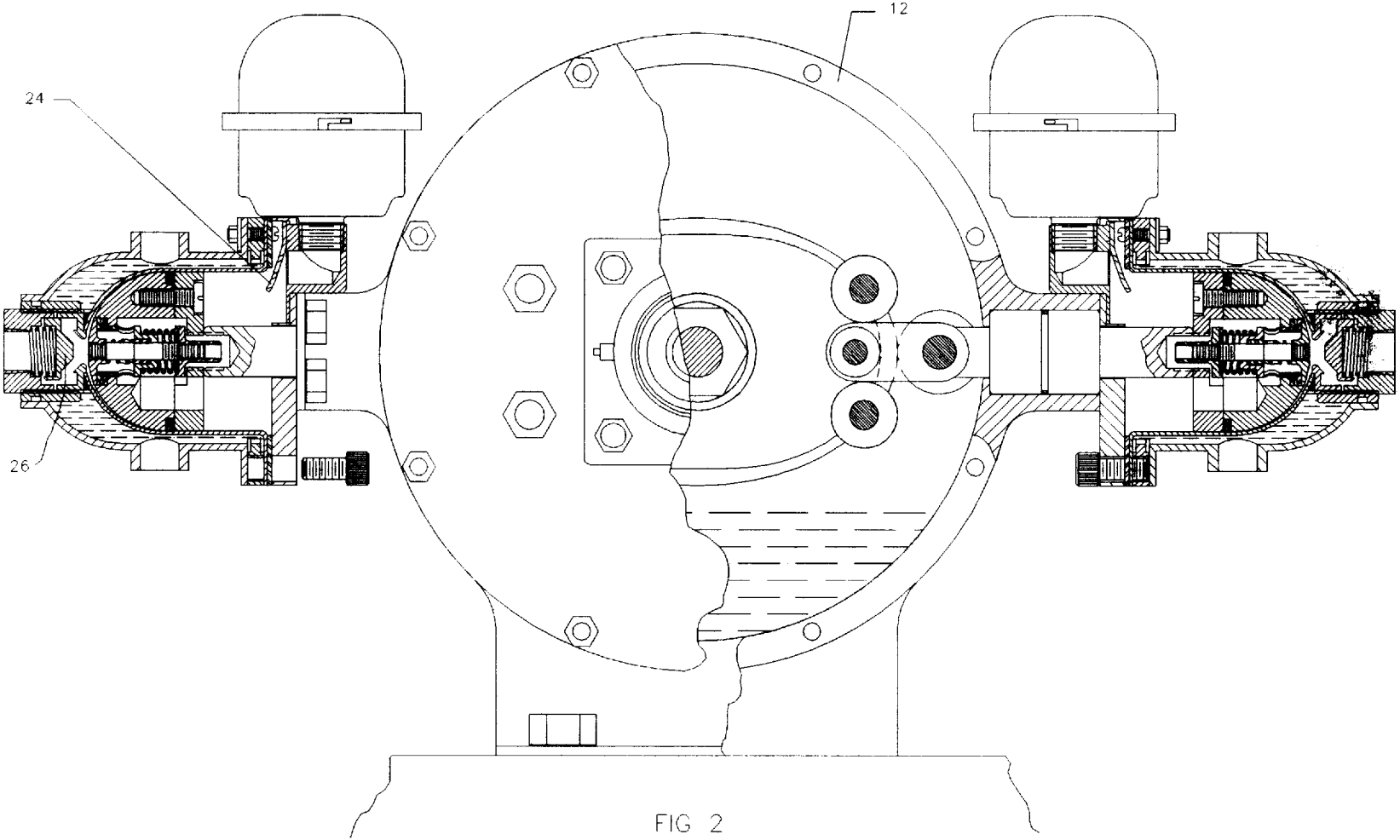
FIG. 2 illustrates the embodiment of the invention shown in FIG. 1 with the rotator at the top of the compression stroke.

FIG. 2 illustrates the embodiment of the invention shown in FIG. 1 with the rotator at the top of the compression stroke with the inlet valves 24 and outlet valves 26 open.

Figure 3:
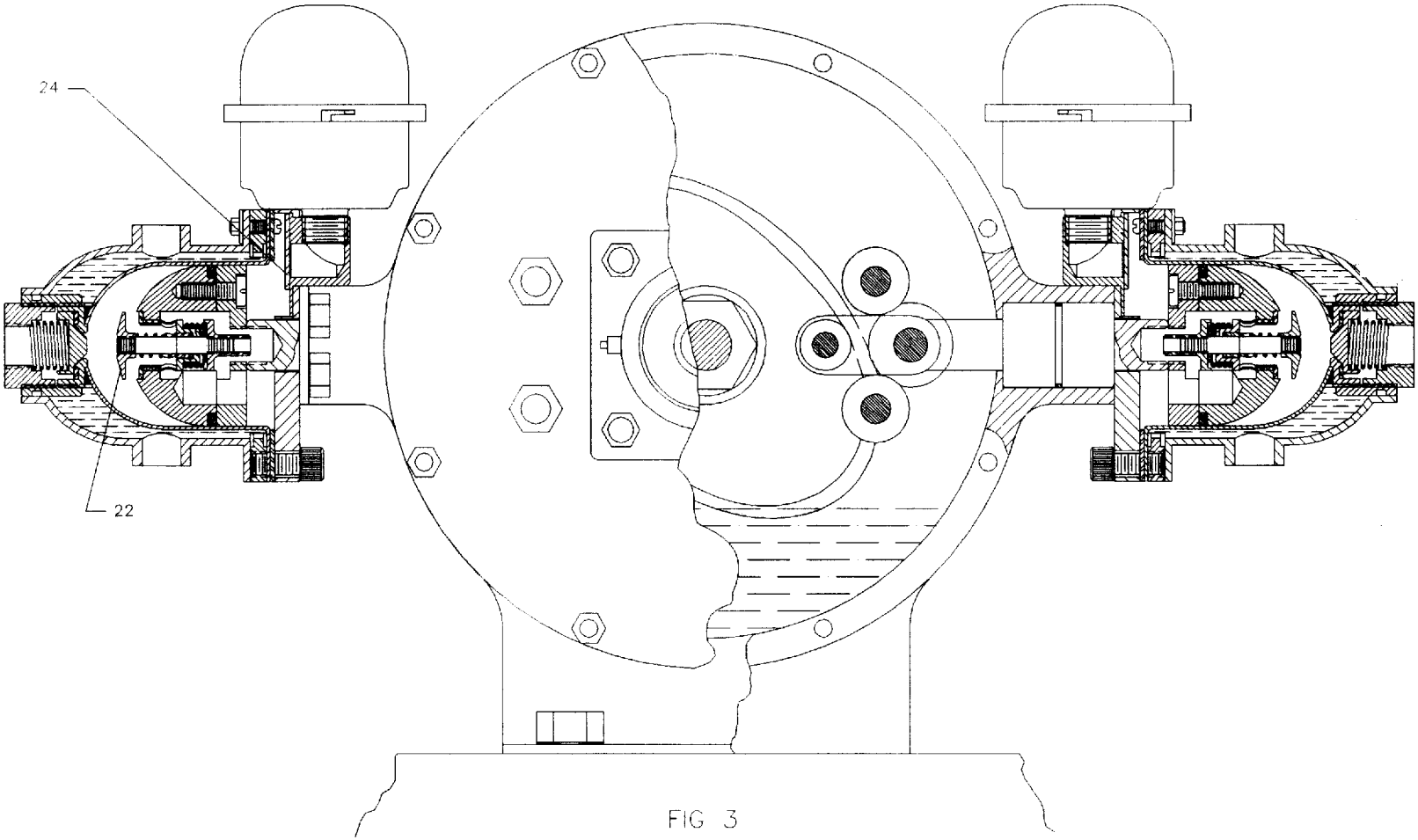
FIG. 3 illustrates the embodiment of the invention shown in FIG. 1 with the rotator in an intake stroke mode.

FIG. 3 illustrates the embodiment of the invention shown in FIG. 1 with the rotator in an intake stroke mode. The piston valves 22 are open and the inlet valves 24 are closed.

Figure 4:
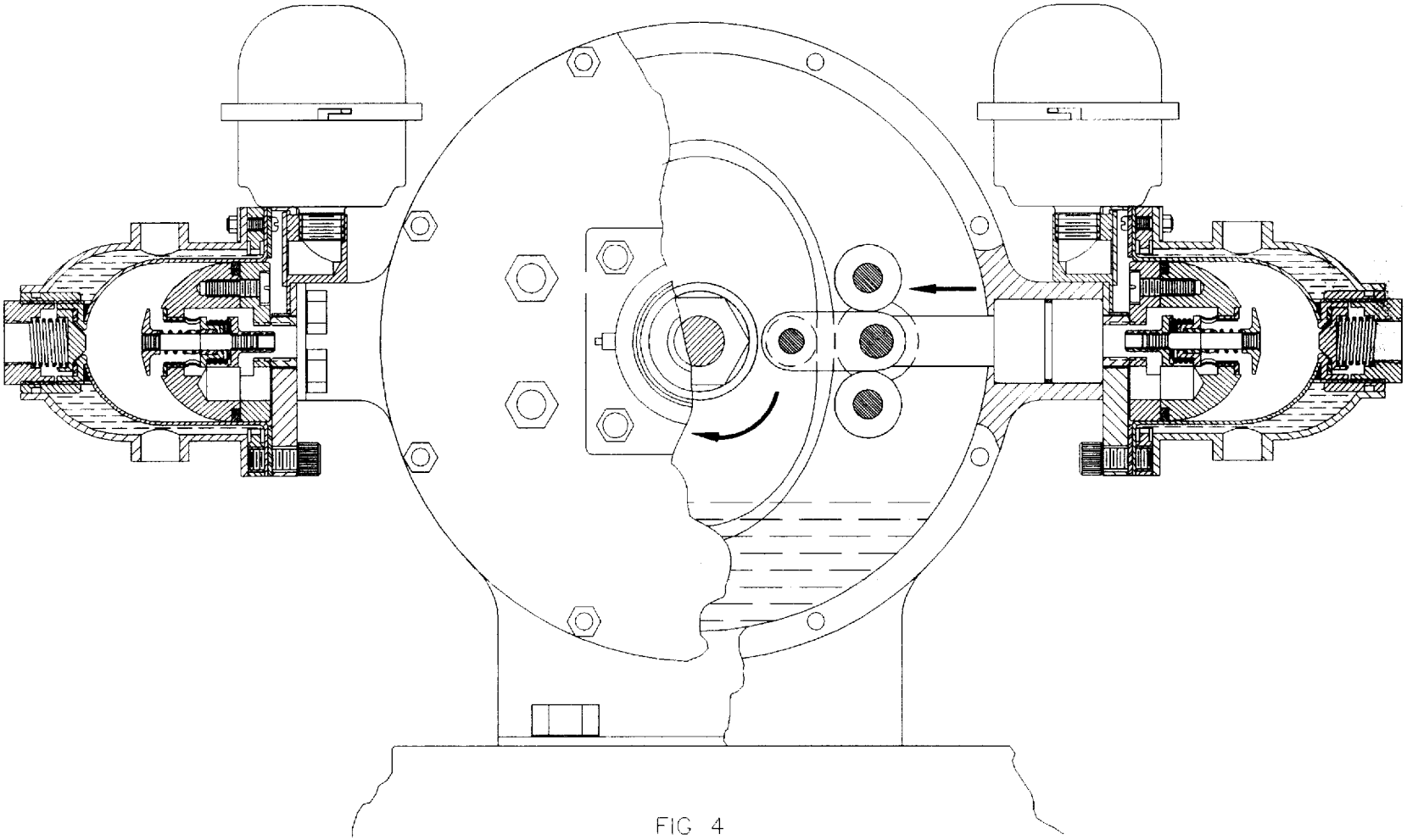
FIG. 4 illustrates the embodiment of the invention shown in FIG. 1 with the rotator at the bottom of the intake stroke.

FIG. 4 illustrates the embodiment of the invention shown in FIG. 1 with the rotator at the bottom of the intake stroke.

Figure 5:
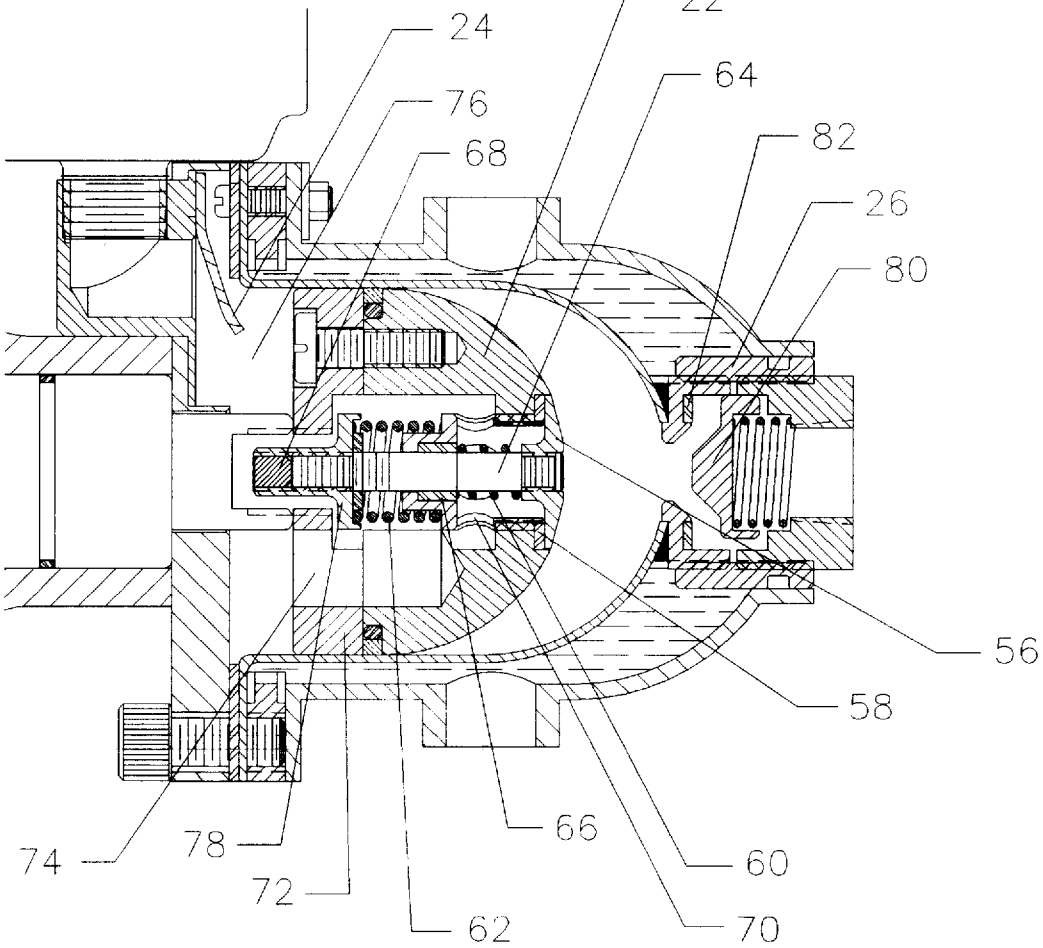
FIG. 5 illustrates a side cross sectional view of the piston and cylinder illustrated in FIG. 1.

FIG. 5 illustrates an exploded side cross sectional view of the thin walled piston and cylinder system illustrated in FIG. 1 with the linear piston valve 22 shown closed and the inlet valve 24 shown open during compression. The piston valve 22 has a piston cap 56 made of a heat resistant material. The piston cap 56 is seated against a silicone seal 58 via an unloading compression spring 60 opposed by an offset compression spring 62. The piston shaft 64 is held in line with a linear bearing 66 as shown. At the base of the piston shaft 64 is a set screw 68 to periodically adjust the piston shaft 64 and cap 56. The piston valve 22 has air passages 70 through the valve guide which are in communication with the adaptor 72 air passages 74 and the inlet air passages 76. An inertia weight and adjustment nut 78 is included to also periodically adjust the spring tension to adjust the piston cap 56 closure tension and timing.

The outlet valve 26 has a spring biased check valve 80 to prevent air from entering the cylinder 18 during the decompression stroke. It is sealed with a silicone seal 82.

Figure 6:
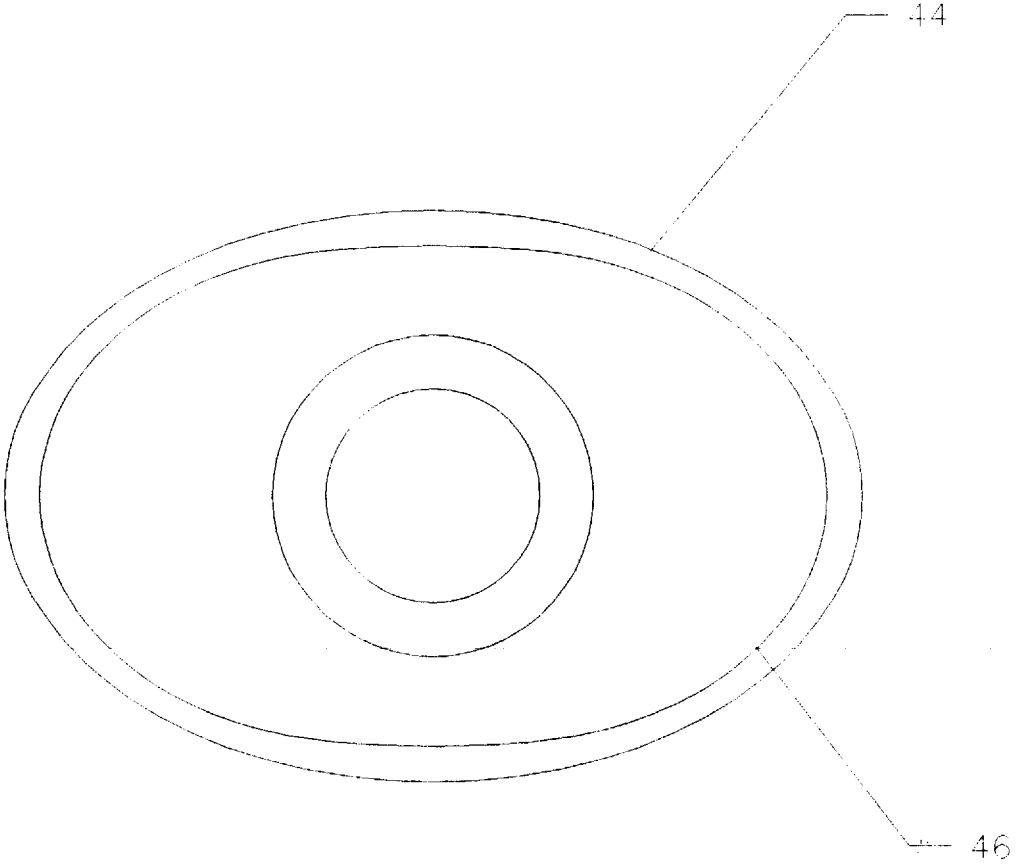
FIG. 6 illustrates a side view of a preferred rotator.

FIG. 6 is a side view of a preferred binodal rotator 38 shown in FIG. 1. The rotator 38 has a guide rail system along its perimeter edge. The outer rail surface 44 creates an alternative pushing force against the cam follower system as the rotator 38 turns. A second inner pulling surface 46 has an interior curve that allows the rotator 38 to without locking against the cam followers 52,54.

Figure 6A:
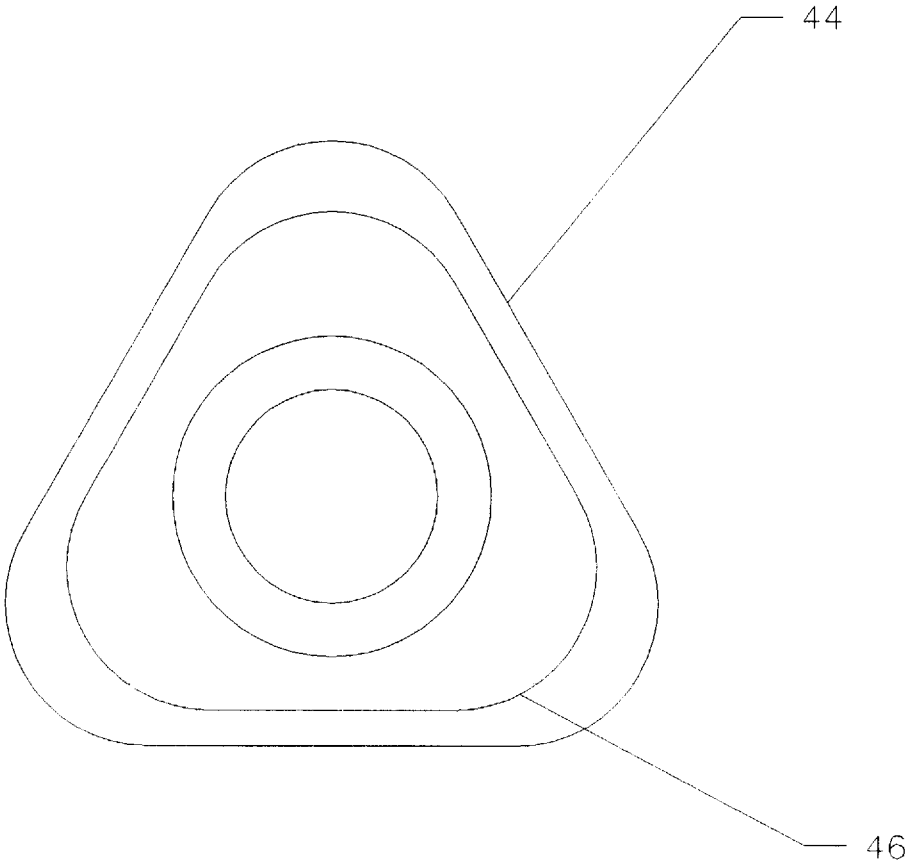
FIG. 6*a* illustrates a side view of another preferred rotator.

FIG. 6*a* illustrates a side view of another preferred rotator configured as a trimodal rotator.

Figure 7:
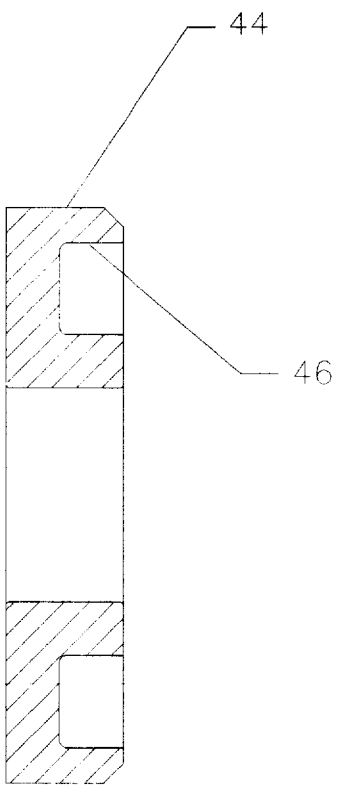
FIG. 7 illustrates a cross-sectional view of the preferred rotator shown in FIG. 6.

FIG. 7 illustrates a cross-section view of the preferred rotator 38 shown in FIG. 8 showing the outer rail surface 44, and the inner pulling surface 46.

Although this specification has made reference to the illustrated embodiments, it is not intended to restrict the scope of the appended claims. The claims themselves recite those features deemed essential to the invention.

We claim:

1. A motion conversion rotator apparatus for a reciprocating piston system comprising:

a housing with walls defining an inner rotator chamber surrounding a drive shaft, at least two opposed cylinders mounted within the walls of the housing spaced equidistant apart about the inner rotator chamber, at least two equal mass counterbalanced opposing reciprocating pistons mounted within each respective opposed cylinder, at least two piston rods each having a first end attached to a piston and a second end extending into the rotator chamber to reciprocate uniformly about a center of rotation to maintain a center of mass, track guide means attached to the housing and associated with the second end of each piston rod to hold said second end in alignment as it reciprocates back and forth, a rotator with at least two equidistant nodal ends attached to a drive shaft journal mounted to the housing to rotate within the rotator chamber, said rotator having guide rail system means along its perimeter edge, and cam follower means mounted to run along the guide rail system and operably associated with the second ends of the piston rods to alternatively push and pull the opposed pistons in response to the rotation of the rotator.

2. A motion conversion rotator apparatus according to claim 1, wherein the rotator has an elliptical shape with two nodes located 180 degrees apart.

3. A motion conversion rotator apparatus according to claim 1, wherein the rotator has a triangular shape with the nodes located 120 degrees apart.

4. A motion conversion rotator apparatus according to claim 1, wherein the housing defines an oil reservoir into which the rotator nodal ends dip to continually lubricate the guide rail system.

5. A motion conversion rotator apparatus according to claim 1, wherein the cam follower means comprise:

a piston rod structured as a linear shaft attached to a carriage arrangement having:

a. a set of pushing and pulling cam followers attached to the piston rod and mounted onto and along the guide rail system means, i. said pushing cam followers travelling the outer configuration of the guide rail system means to be pushed by the rotator as the rotator turns, and ii. said pulling cam follows traveling the inner configuration of the guide rail system means to be pulled as the rotator turns, and b. guide rail cam followers associated with the piston rod and located on both sides of the track guide means to prevent rotation of the piston rod and reduce side load during rotation of the rotator.

6. A motion conversion rotator apparatus according to claim 1, wherein the guide rail system comprises a rail running along the perimeter of the rotator with an outer rail surface which creates an alternative pushing force against the cam follower means as the rotator turns initially, and an inner rail surface which creates a pulling force as the rotator turns to pull the cam follower means as the rotator completes its turn.

7. A motion conversion rotator apparatus according to claim 1, wherein the guide rail system comprises a rail running along the perimeter of the rotator with an inner rail surface which creates an alternative pushing force against the cam follower means as the rotator turns initially, and an outer rail surface which creates a pulling force as the rotator turns to pull the cam follower means as the rotator completes its turn.

8. A motion conversion rotator apparatus according to claim 1, wherein the rotator is symetrically shaped and dynamically balanced.

9. A motion conversion rotator apparatus for a gas compressor comprising:

a housing with walls defining an inner rotator chamber, at least two aligned and opposed thin walled hemispherical compression cylinders mounted within the housing walls opening into the inner rotator chamber, at least two equal mass counterbalanced opposing thin walled reciprocating dome shaped pistons mounted within each respective opposed cylinder, valve means in the pistons to admit compressible gas into the cylinders, conduit means in the housing in communication with the cylinders to remove compressed gas from the cylinders, cooling means for cooling the compressed gas leaving the cylinder to prevent heat build-up, piston rods with a first end attached to a piston and a second end extending into the rotator chamber, track guide attached to the housing and associated with the piston second ends to hold said ends in alignment as they move back and forth, a rotator with at least two equidistant nodal ends attached to a drive shaft journal mounted to the housing to rotate within the rotator chamber, said rotator having a guide rail system along its perimeter edge, and cam follower means mounted to run along the guide rail system and operably associated with the second ends of the piston rods to alternatively push and pull the opposed pistons along a single plane in response to the rotation of the rotator.

10. A motion conversion rotator apparatus for a gas compressor according to claim 9, wherein the valve means is a linear unloading valve which remains open until a predetermined RPM of the rotator is achieved.

11. A motion conversion rotator apparatus for a gas compressor according to claim 9, wherein the rotator has an elliptical shape with two nodes located 180 degrees apart.

12. A motion conversion rotator apparatus for a gas compressor according to claim 9, wherein the rotator has a triangular shape with three nodes located 120 degrees apart.

13. A motion conversion rotator apparatus for a gas compressor according to claim 9, wherein the housing defines an oil reservoir into which the rotator ends dip to continually lubricate the guide rail system.

14. A motion conversion rotator apparatus for a gas compressor according to claim 9, wherein the cam follower means comprise:

a piston rod structured as a linear shaft attached to a carriage arrangement having:

a. a piston rod structured as a linear shaft attached to a carriage arrangement having:

a. a set of pushing and pulling cam followers attached to the piston rod and mounted onto and along the guide rail system means, i. said pushing cam followers travelling the outer configuration of the guide rail system means to be pushed by the rotator as the rotator turns, and ii. said pulling cam followers traveling the inner configuration of the guide rail system means to be pulled as the rotator turns, and b. guide rail cam followers associated with the piston rod and located on both sides of the track guide means to prevent rotation of the piston rod and reduce side load during rotation of the rotator.

15. A motion conversion rotator apparatus for a gas compressor according to claim 9, wherein the guide rail system comprises a rail running along the perimeter of the rotator with an outer rail surface which creates an alternative pushing force against the cam follower means as the rotator turns initially, and an inner lip which creates a pulling force as the rotator turns to pull the cam follower means as the rotator completes its turn.

16. A motion conversion rotator apparatus for a gas compressor according to claim 9, wherein the rotator is symetrically shaped and dynamically balanced.

17. A motion conversion rotator method for a reciprocating piston system having a housing with walls defining an inner rotator chamber surrounding a journal mounted drive shaft, at least two aligned and opposed cylinders mounted within the walls of the housing spaced equidistant apart about the inner rotator chamber, at least two equal mass counterbalanced opposing reciprocating pistons mounted within each respective opposed cylinder, and at least two piston rods each having a first end attached to a piston and a second end extending into the rotator chamber to reciprocate uniformly about a center of rotation to maintain a center of gravity, comprising:

attaching track guide means to the housing and associated with the second ends of each piston rod to hold said ends in alignment as said ends reciprocate back and forth, attaching a rotator with at least two equidistant nodal ends to the drive shaft to rotate within the rotator chamber as the drive shaft rotates, said rotator having a guide rail system along its perimeter edge, and mounting cam follower means operably associated with the second ends of the piston rods to run along the guide rail system and to alternatively push and pull the opposed pistons in response to the rotation of the rotator.

* * * * *